United States Patent [19]

Harris et al.

[11] 4,239,503

[45] Dec. 16, 1980

[54] SOFT ACTING PHENOL-FORMALDEHYDE RESIN BONDED GRINDING WHEEL

[75] Inventors: Denis I. Harris, Upper Nazeing; Luke Staples, St. Albans, both of England

[73] Assignee: Norton Company, Worcester, Mass.

[21] Appl. No.: 688,532

[22] Filed: May 21, 1976

[30] Foreign Application Priority Data

Aug. 4, 1975 [GB] United Kingdom ..... 32479/75

[51] Int. Cl.[3] ..... C08J 5/14

[52] U.S. Cl. ..... 51/298; 51/295; 260/38; 260/39 SB

[58] Field of Search ..... 51/295, 298; 260/37 R, 260/38, 39 SB

[56] References Cited

U.S. PATENT DOCUMENTS

| | | | |
|---|---|---|---|
| 2,769,700 | 11/1956 | Goepfert | 51/298 |
| 2,897,074 | 7/1959 | Redfarn | 51/298 |
| 3,020,254 | 2/1962 | Less et al. | 51/298 |
| 3,208,836 | 9/1965 | Biglin et al. | 51/298 |
| 3,406,020 | 10/1968 | D'Alessandro | 51/298 |
| 3,820,290 | 6/1974 | Erikson | 51/298 |

*Primary Examiner*—Donald J. Arnold

*Attorney, Agent, or Firm*—Arthur A. Loiselle, Jr.

[57] ABSTRACT

The invention is a phenol-formaldehyde resin bonded grinding wheel which has grinding characteristics like that of shellac bonded grinding wheels. This soft, mild grinding action results from the basic phenol-formaldehyde resin initially containing from 0.5 to 2.5% by weight of hexamethylenetetramine, when used in conjunction with a material such as liquid one-stage phenol-formaldehyde resin, or furfural as the bond pick-up agent.

8 Claims, No Drawings

SOFT ACTING PHENOL-FORMALDEHYDE RESIN BONDED GRINDING WHEEL

BACKGROUND OF THE INVENTION

The invention relates to rigid grinding tools. More specifically, the invention is concerned with organic polymer bonded grinding wheels.

Phenol-formaldehyde condensation resins have been known as binders for abrasive particles since as early as 1909, as taught by Leo H. Baekeland in U.S. Pat. No. 942,808. The Baekeland patent teaches the synthesis of liquid one-stage resins, the incorporation therein of abrasive particles, and the subsequent heat curing of the liquid phenol-formaldehyde binder to form a grinding wheel or other abrasive product. The term one-stage resin, as used herein, has the art accepted connotation i.e. a phenol-formaldehyde condensation product formed from the reaction of phenol and formaldehyde in which the formaldehyde is initially present in at least equimolar amounts as the phenol; the resulting product is heat hardenable to an infusible, insoluble state with the application of heat. This self curing characteristic is a result of the presence of terminal and pendant methylol groups on the phenolic nuclei of the prepolymer.

At least by 1925 the second type of phenol-formaldehyde condensation resin, the so-called two-stage resin, was being utilized as the bond or binding agent for abrasive grains as disclosed in U.S. Pat. No. 1,537,454 to Frank P. Brock. A two-stage resin is one synthesized by reacting a molar excess of phenol with formaldehyde. The resulting product is a permanently fusible, soluble prepolymer. The permanently fusible prepolymer is rendered infusible and insoluble by mixing therewith, a methylene group donor such as hexamethylenetetramine and subsequently having the combination mixed with abrasive grain. This type of resin is generally used in powder form. Brock forms a rigid abrasive tool by first mixing the abrasive grain with about 10% by weight of either a heat reactive one-stage phenol-formaldehyde resin or a heat reactive two-stage resin, the resins being preferably in powder form. To this mixture is added a liquid such as furfuraldehyde in sufficient quantity to cause the mix to become sticky or tacky. The mixture is then pressed in an appropriately shaped mold and heat treated to cure the polymeric bond.

The foregoing patents describe the early development of one-stage and two-stage phenol-formaldehyde condensation polymers as binders for grinding wheels. During the chronological interim, U.S. Pat. No. 1,218,146 issued to F. G. Wiechmann. The patent teaches reacting 100 parts of phenol with 10 to 35 parts of formaldehyde in the presence of a substance which will facilitate the production of an anhydrous reaction product; one such substance being dry ammonia gas. As discussed, above, when the molar ratio of phenol to formaldehyde is greater than one then the resulting product formed is of the two-stage type i.e. not a self curing prepolymer but one to which a methylene group donor must be added to bring about further polymerization. Normally an acid catalyst is used to synthesize two-stage resins but basic catalysis with an excess of phenol can produce a two-stage resin. However, according to the teaching of U.S. Pat. No. 1,218,146 the resulting product is a viscous, non-hygroscopic syrup that cures upon the application of heat to an insoluble, infusible polymer. Thus although the patent teaches reacting a mixture where phenol is present in great excess (100 to 10), the reaction product is not a two-stage resin, which will not cure under heat without the addition of a methylene donor, but is rather a self curing one-stage resin which must contain terminal and/or pendant methylol groups like the product taught in the Baekeland U.S. Pat. No. 942,808.

During the years to follow, phenol-formaldehyde resins became the basis for a sizeable segment of the polymer industry. Dozens of phenolic resins were developed which were modifications of the two basic types. Powdered two-stage resins became and are still available in which the molecular weight of the prepolymer varies. The hexamethylenetetramine content of these resins vary from 8% to as high as 13% depending on the degree of cross-linking and thermal stability desired. There are a large number of commercial two-stage resins which have been modified by the addition thereto of thermoplastic polymers such as polyvinyl alcohol, polyvinyl butyral, or the like, the effect of such additions being to lower heat resistance, which means softer grinding action when used as a binder for grinding wheels. To produce a similar product, but one with less thermal susceptibility, powdered one-stage resin has been blended with a hexamethylenetetramine containing two-stage resin. There are powdered one-stage resins commercially available but these are not widely used by the grinding wheel industry. One such use however, is disclosed by G. J. Goepfert in U.S. Pat. No. 2,769,700 wherein a powdered one-stage resin is utilized, in combination with a liquid one-stage resin, to form a diamond abrasive containing grinding wheel.

Although powdered one-stage resins are not widely used by the grinding wheel industry, liquid one-stage resins are. Liquid resins are used as so-called pick-up agents for the powdered bond which is made up of powdered resin and usually a powdered filler material. The abrasive grains are thoroughly wetted or coated with the liquid resin to which is then added, the powdered bond. The conglomeration is then mixed until essentially all of the powdered bond is picked up by the tacky coating of liquid resin on the abrasive grain. The mixture is then formed and heat treated to cure both the liquid and powdered phenol-formaldehyde resins.

Phenol-formaldehyde polymers have been and remain today the most widely used polymers for grinding wheel bonds. The success of this material is due primarily to its high mechanical strength and excellent resistence to thermal degradation as compared to other thermosetting resins such as the unsaturated polyesters and the epoxy resins. However, there are some grinding applications where these superior properties are a detriment, for example in such grinding operations as polishing, and some precision grinding operations, particularly where the metal may be heat sensitive. To satisfy this need bonds were developed which were more heat sensitive than the phenol-formaldehyde bonds discussed thus far. Shellac bonds were used, as well as alkyd bonds such as those described in U.S. Pat. No. 2,125,893. A soft acting i.e. more heat sensitive, phenol-formaldehyde based grinding wheel bond was described by Rupert S. Daniels in his U.S. Pat. No. 2,312,392. To make the polymer more heat sensitive, Daniels reduced the amount of cross-linking in the cured bond by reducing the amount of hexamethylenetetramine compounded with the powdered prepolymer. Accordingly the hexamethylenetetramine content was maintained between 3 and 6% based on the weight of dry, powdered prepolymer with the preferred concentration being 5%. Despite the early teachings of this Daniels patent, it does not appear to have been utilized by grinding wheel manufacturers as a substitute for shellac and/or alkyd resins.

An extensive list of fillers, i.e. materials added to the organic polymer bond, have been utilized at one time or another in bonded abrasive products. Of this large list only a relative few are widely used on a commercial basis viz. sodium chloride, iron sulfide, potassium fluorborate, sodium fluoraluminate, tin powder, fine aluminum oxide, fine silicon carbide, graphite, calcium carbonate, and various combinations thereof. Generally, fillers are not added to the polymeric bond in grinding wheels for the sake of extending or diluting the polymer, as is commonly done in other polymer based articles of manufacture. Fillers are employed in abrasive products most often for their beneficial effect on the grinding characteristics of the abrasive product, and sometimes as a reinforcing agent. Calcium oxide is another material added to polymeric bonds. This material is generally not considered a filler; it is added to the bonds of the harder or denser types of phenol-formaldehyde resin bonded abrasive products for the purpose of scavenging water generated during the curing process of such abrasive product types.

Bonded abrasive products are manufactured predominantly by two distinct methods. Softer grade products, i.e. those containing a significant amount of porosity, are made by the cold-pressing method. Abrasive grain is wetted with a pick-up agent; a powdered prebatched bond made up of a thermosettable polymer and filler if desired, is then added to the wetted abrasive and the combination mixed until all or most of the powdered bond is picked up by the wetted abrasive; a predetermined quantity of this mix is placed in an appropriately shaped mold and spread uniformly therein; the mold is assembled and the mix pressed at room temperature to the desired density; the green wheel is then removed from the mold and subjected to a heat treatment to advance or cure the polymeric bond.

The other manufacturing method is the so called hot-pressing method. This method is essentially the same as the cold-pressing method described above, up to the point of the actual pressing. Instead of applying pressure at room temperature, the mold set-up and mix contained therein are heated e.g. to 160° C. while the pressure is being applied. This method is used to manufacture wheels which are essentially free of pores. Products made in this manner are commonly referred to as zero porosity. However, some of these products do contain as much as 5% porosity.

Both of the foregoing processes are well known and widely, if not almost exclusively, used for the commercial production of bonded abrasive products.

SUMMARY OF THE INVENTION

As is customary in the art, the term "one-stage resin" as used herein means a phenol-aldehyde prepolymer containing a substantial number of methylol groups, as the result of having been synthesized by reacting a molar ratio of phenol:aldehyde of less than 1. Likewise, the expression "novolac" means the permanently fusible, soluble reaction product of phenol and an aldehyde reacted in a ratio of phenol:aldehyde greater than 1. Similarly the term "two-stage resin" designates the physical combination of a novolac with a methylene group donor, such as hexamethylenetetramine; upon the application of heat the "two-stage resin" will cross link to a permanently infusible, insoluble polymer.

The major problems associated with shellac bonded grinding wheels are eliminated by the present invention. A typical shellac cure cycle can run anywhere from about 3 to 5 days while phenol-formaldehyde based grinding wheel bonds can be cured in from 4 to 24 hours. Shellac, being a natural product, is very inconsistent in its properties thus resulting in a product whose final properties are difficult to control; the resin system of the present invention is easily and closely controllable. Finally, shellac bonded grinding wheels are inherently weaker in mechanical strength than the phenol-formaldehyde bond of the invention; particularly, shellac is more susceptible to deterioration by water than the low hexamethylenetetramine phenolic resins described herein.

The invention is a phenol-aldehyde resin bonded abrasive product with the mild grinding properties normally associated only with shellac or alkyd resin bonded abrasive products. This end result is accomplished by utilizing, as the polymeric binder, a powdered novolac resin which contains admixed therewith, a methylene group donor in a quantity so as to provide only 0.3 to 1.5% by weight of methylene groups based on the combined weight of the phenol-aldehyde resin and the methylene group donor. The source of methylene groups is preferably hexamethylenetetramine, an aldehyde like formaldehyde or furfuraldehyde, trimethylol phenol, a one-stage phenol-aldehyde resin, or mixtures of these materials. Prior art phenol-aldehyde resins, by contrast, contain from 3.6 to 7.8% by weight of methylene groups, based on the combined weight of the methylene group donor and the novolac.

When the grinding wheel specification involved contains abrasive grit coarser than 320 mesh (U.S. Standard Sieve Series), then a liquid pick-up agent is generally applied to the abrasive prior to addition of the powdered bond, for the purpose of insuring uniform distribution of the powdered bond. In this case, there can be two sources of methylene groups viz. the pick-up agent if it is an aldehyde like furfuraldehyde, or, a liquid one-stage resin; and a powdered methylene group donor in the powdered novolac such as those described above. If the grinding wheel being fabricated is 320 mesh or finer, uniform mixings can be made without the aid of a liquid pick-up agent, in which case the methylene group donor is entirely contained in the powdered two-stage resin.

Within the scope of the instant invention are those abrasive products made up of from 44 to 60% by volume of abrasive, 2 to 56% by volume of bond, and 0 to 38% by volume of pores. The bond may incorporate therein from 0 to 30% by weight of filler and from 5 to 30% by weight of a liquid bond pick-up agent, with 40 to 90% by weight of the two-stage resin.

DESCRIPTION OF THE PREFERRED EMBODIMENTS

According to the best mode of practicing the invention a liquid one-stage phenol-formaldehyde resin is used as the pick-up agent for the powdered two-stage phenol-formaldehyde resin bond. However, when the volume percent of porosity in the finished wheel is approximately 20% it is generally advantageous to use furfuraldehyde or the like as the pick-up agent, as is well known in the art; when the shift is made to a material such as furfural, a moisture scavenger, such as active calcium oxide is incorporated in the powdered bond. The amount of liquid pick-up agent employed can vary significantly as a function of bond composition, abrasive grit size, manufacturing methods used, and even ambient conditions of temperature and relative humidity at the time of manufacture. Generally, acceptable bond-abrasive mixings cannot be made with less than 5 nor more than 30% by weight of total bond as liquid pick-up agent.

Hexamethylenetetramine is the preferred, solid methylene group donor. It is incorporated in the powdered novolac in a range of 0.5 to 2.5% by weight based on the combined weights of novolac and hexamethylenetetramine. The quantity of hexamethylenetetramine which results in a wheel with grinding properties closest to that of a shellac wheel, is 1 to 2% by weight when liquid one-stage phenol-formaldehyde resin is used as the pick-up agent. Alternatively, a powdered one-stage resin may be substituted for the hexamethylenetetramine, by preblending it with powdered novolac, in a quantity so as to provide from 0.3 to 1.5% by weight of methylene groups based on the total weight of the two types of resin.

Of prime concern is the mechanical strength of a grinding wheel and specifically its centrifugal bursting strength. To evaluate this property of products made according to the present invention, 3 sets of seven wheels $8\times\frac{1}{2}\times1''$ were manufactured from two-stage resin containing 0, 0.77, 1.51 and 3.03% by weight of hexamethylenetetramine, in the following manner:

13.25 pounds of 100 grit aluminum oxide abrasive was placed in a vertical spindle mixer. To the abrasive was added 0.35 pound of liquid one-stage phenol-formaldehyde resin, and the two mixed for several minutes until the abrasive was uniformly wet with the liquid resin. At this point 1.94 pounds of powdered two-stage phenol-formaldehyde resin was slowly added to the wet abrasive and mixing was continued until the wet abrasive had picked up essentially all of the powdered resin. The mix so prepared was screened through a 46 mesh screen to eliminate any agglomerates. In a steel mold set-up having an I.D. of 8 3/16" and a 1" arbor, was placed 2.09 pounds of the mix, the top plate put in position and the mix pressed at room temperature to a thickness of $\frac{1}{2}''$. The wheel was then removed from the mold and placed on a refractory plate or batt.

When all 28 wheels were molded, they were cured in a mechanically convected oven at a temperature of 175° C. The wheels had a volume percent make-up of 48% abrasive, 22% bond, and 30% pores.

Of the 7 wheels of each two-stage resin variation i.e. resins containing 0, 0.77, 1.51, and 3.03% by weight of hexamethylenetetramine 3 were speed tested to destruction dry and 3 after having been soaked in water at room temperature for 10 days. The strength results were as follows:

| % Hexa in Resin | Centrifugal Speed @ Wheel Rupture | |
|---|---|---|
| | Dry | Wet |
| 0 | 18,600 sfpm* | 15,200 sfpm* |
| 0.77 | 21,600 sfpm* | 15,500 sfpm* |
| 1.51 | 22,400 sfpm* | 18,900 sfpm* |
| 3.03 | 22,700 sfpm* | 18,000 sfpm* |

*surface feet per minute

This type of wheel, in commercial use, is run at a maximum operating speed of 7000 sfpm. For the sake of safety, wheels are not used at any given operating speed unless their centrifugal bursting or rupture strength is at least 50% higher than the operating speed. As evident from the data above all of the two-stage resin variations produced wheels with strengths well in excess of the 10,500 sfpm that the foregoing rule requires.

Identical wheels were tested in a grinding operation typically done with a shellac bonded grinding wheel viz. surface grinding 410 stainless steel using a coolant. The specifics of the test were as follows:

| | |
|---|---|
| Machine | Norton S-3 6 × 18" surface grinder |
| Wheel Speed | 6700 s.f.p.m. |
| Table Traverse | 30 ft. per minute |
| Unit/Total Downfeed | 0.5/20 mils |
| Material | 410 stainless steel |
| Coolant | sodium nitrite and alkanolamine in water |

The grinding test was conducted with wheels made from the several bond variations using a standard shellac wheel as a control and reference point with the following results.

| Bond | Ww (mils) | MR (mils) | G Ratio | Ave. Peak Power (watts) | Surface Finish (AA)* |
|---|---|---|---|---|---|
| Shellac | 44.1 | 37.8 | 0.60 | 665 | 83–87 |
| novolac + 0% hexa | 66.0 | 26.7 | 0.26 | 500 | 85–90 |
| novolac + 0.77% hexa | 42.8 | 38.7 | 0.59 | 750 | 75–80 |
| novolac + 1.51% hexa | 32.5 | 42.6 | 0.85 | 850 | 85–90 |
| novolac + 3.03% hexa | 26.0 | 47.1 | 1.17 | 1150 | 80–85 |

*the arithmetic average of profilometer measurements

The surface finish produced by all of the low hexamethylenetetramine containing wheels was acceptable and about the same as that produced by the shellac wheel. The other grinding characteristics, however, were not so consistent. All of the hexamethylenetetramine levels resulted in usable wheels but the two extremes of the range, i.e. the 0% and 3.03% hexamethylenetetramine level, departed drastically in wheelwear (Ww) and material removal (MR) from those grinding characteristics of the standard shellac wheel. The Ww of the 0% hexamethylenetetramine wheel was approximately 50% greater than the shellac wheel while the MR for the former was 29% lower than that property of the shellac wheel. The 3.03% hexamethylenetetramine wheel also produced substantial departure from the properties of the shellac wheel. However, in this case the wheel is too hard acting as shown by the 26.0 mils Ww and the very high average peak power of 1150 watts as compared to 665 watts for the shellac wheel. For reasonable duplication of the grinding properties of a shellac wheel, the hexamethylenetetramine added to the novolac should produce a two-stage resin containing from 0.5 to 2.5% by weight of the methylene bridge (group) donor.

The two-stage resin composition which produced a wheel closest to a shellac wheel was that containing 0.77% hexa, when an amount of liquid one-stage phenol-formaldehyde resin equal to about 15% of the combined weights of the liquid one-stage resin and the powdered two-stage resin. If the amount of liquid one-stage resin is increased or decreased, then the optimum hexamethylenetetramine level will increase or decrease within the prescribed limits of 0.5 to 2.5% by weight of the two-stage resin.

It should also be understood, that the effect of bake or cure cycle variations and filler additions to the bond, are within the scope of the instant invention. It is well known, for example, that low temperature bake cycles applied to phenol-formaldehyde bonded abrasive products result in a relatively undercured bond and a wheel which is softer acting in its grinding characteristics. The addition of fillers to the bond can be used to harden or soften the grinding action, or to improve the grinding efficiency, depending on the particular choice of filler or fillers.

What is claimed is:

1. A bonded abrasive product comprising abrasive grain and a thermoset polymeric bond, wherein the improvement comprises:

A thermoset polymeric bond based on the reaction product of a phenol and an aldehyde in a molar ratio of said phenol to said aldehyde of greater than 1, and wherein said reaction product is cured by a methylene group donor, said donor being present in sufficient quantity so as to provide from 0.3 to less than 1.2% by weight of methylene groups, based on the weight of said methylene group donor and said reaction product of said phenol and said aldehyde.

2. The abrasive product of claim 1 wherein said methylene group donor is one selected from the group consisting of hexamethylenetetramine, an aldehyde, trimethylol phenol, one stage phenol-aldehyde resin, and mixtures thereof.

3. The abrasive product of claim 2 including a reactive liquid pick-up agent for said bond, the liquid pick-up agent being selected from the group consisting of furfuraldehyde, liquid one stage phenol-formaldehyde resin, and mixtures thereof.

4. An abrasive product comprising abrasive grain, a reactive liquid bond pick-up agent, and a thermoset polymeric bond, wherein the improvement comprises:

a thermoset polymeric bond based on the reaction product of phenol and an aldehyde in a molar ratio of phenol to aldehyde greater than 1, and wherein said reaction product is cured with an amount of hexamethylenetetramine of from 0.5 to less than 2% of the combined weight of hexamethylenetetramine and phenol-aldehyde reaction product.

5. The abrasive product of claim 4 wherein said bond pick-up agent is a liquid phenol-aldehyde resin based on the reaction product of phenol and an aldehyde in a molar ratio of aldehyde to phenol equal to at least 1.

6. The abrasive product of claim 4 wherein said bond pick-up agent is an aldehyde.

7. The abrasive product of claim 4 wherein said thermoset polymeric bond includes from 0% to 30% by weight or filler.

8. An abrasive product consisting essentially of from 44 to 60% by volume of abrasive, 2 to 56% by volume of bond, and 0 to 38% by volume of pores; said bond including 5 to 30% by weight of a liquid bond pick-up agent, 0 to 30% by weight of filler 40 to 90% by weight of a thermoset polymeric bond, wherein the improvement comprises:

a thermoset polymeric bond based on the reaction product of a phenol and formaldehyde in a molar ration of said phenol to said formaldehyde greater than 1, and wherein said reaction product is cured with from 1 to less than 2% hexamethylenetetramine, based on the combined weight of said phenol-formaldehyde reaction product and said hexamethylenetetramine.

* * * * *